United States Patent [19]

Hahne

[11] Patent Number: 4,797,933

[45] Date of Patent: Jan. 10, 1989

[54] BASS AMPLIFIER WITH HIGH FREQUENCY RESPONSE

[76] Inventor: Göran Hahne, Enbacken, Svia, Uppsala, Sweden, S-755 90

[21] Appl. No.: 20,437

[22] Filed: Mar. 2, 1987

[30] Foreign Application Priority Data

Mar. 20, 1986 [SE] Sweden ..... 8601308

[51] Int. Cl.[4] ..... H04R 3/00

[52] U.S. Cl. ..... 381/96; 381/98; 330/105; 330/126; 333/28 T

[58] Field of Search ..... 381/98, 96, 59, 103; 330/105, 126; 333/28 T

[56] References Cited

U.S. PATENT DOCUMENTS 4,118,600 10/1978 Stahl ..... 381/98
4,223,273 9/1980 Yokoyama ..... 330/105
4,260,954 4/1981 Crooks ..... 330/105
4,426,552 1/1984 Cowans et al. ..... 381/71

*Primary Examiner*—Forester W. Isen
*Attorney, Agent, or Firm*—Kenyon & Kenyon

[57] ABSTRACT

A method of improving the frequency reproduction at frequencies higher than a certain break frequency (fs) of a bass amplifier known per se within the audio frequency range. The amplifier has a low-pass filter portion (ACE1) and a power amplifier portion (EF) with a current feedback portion (ACE2) in order to get a negative output impedance against the loudspeaker. According to the invention high-pass filtration is carried out from the break frequency (fs) and upwards to about 20 kHz of the signal coming to the amplifier and thereafter a phase shift ($\rho$) is carried out so that a cophasal state is obtained at the break frequency (fs) before the power amplifier portion (EF).

3 Claims, 3 Drawing Sheets

BASS AMPLIFIER WITH HIGH FREQUENCY RESPONSE

TECHNICAL FIELD

This invention relates to a method as well as a circuit arrangement for improving the reproduction of a bass amplifier of the so-called ACE-type at frequencies higher than a certain break frequency within the audio band 20 Hz—20 kHz.

STATE OF ART

U.S. Pat. No. 4,118,600 (Swedish Pat. No. 7603585-6) teaches a method as well as a device for improving the bass reproduction of an electrodynamical loudspeaker element. This known method is used to obtain an extended frequency range of the element and a lower distorsion in the bass register at HIFI-reproduction. The method is utilized in so-called active design of the loudspeaker system, i.e. the amplifier and the loudspeaker are integrated. In such systems it is possible to further reduce the lower break frequency by adding more power to the loudspeaker at low frequencies while the efficiency at higher frequencies is maintained. However, this is possible only up to a certain power limit and therefore, according to this known method, called the ACE-method (amplifier-control-euphonic), attempts have been made to attain better loudspeaker qualities at low frequencies in quite another way. The loudspeaker whose bass reproduction it is desired to improve is driven by an amplifier or an amplifier combination, the effective output impedance of which comprises or is equivalent to a negative impedance connected in series with a parallel resonance circuit. The negative resistance has substantially the same amount as the resistance of the voice coil winding of the loudspeaker. In this way the bass reproduction of the loudspeaker is improved, as an equivalent change of its mechanical parameters such as moving mass, damping and compliance is obtained.

SUMMARY OF THE INVENTION

In the known ACE-connection an improvement is obtained as compensation can be made for the resistance of the voice coil resulting in an improved bass register. However, a disadvantage remains at higher frequencies, viz. the audio signals at these frequencies are damped due to the inductance of the voice coil. This has a slight influence at lower frequencies. Thus, it should be desirable to have an audio bass amplifier that might give an improvement within the whole audio frequency range, i.e. from 20 Hz up to 20 kHz.

Thus, it is the object of this invention to provide a bass amplifier connection of a loudspeaker containing a voice coil having a certain resistance and inductance where the influence of the voice coil at high audio frequencies has been considerably reduced.

The invention is characterized as is apparent from the following claims.

BRIEF DESCRIPTION OF DRAWINGS

The invention will be described more in detail with reference to the enclosed drawings, wherein.

EMBODIMENTS

Figure 1:
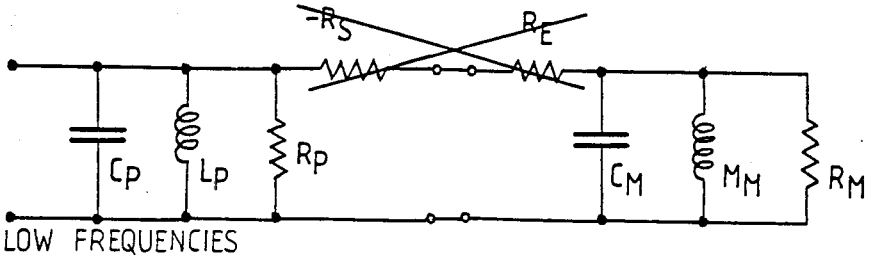
FIG. 1 shows an equivalent diagram of the known bass amplifier-loudspeaker connection at low frequencies.
Figure 2:
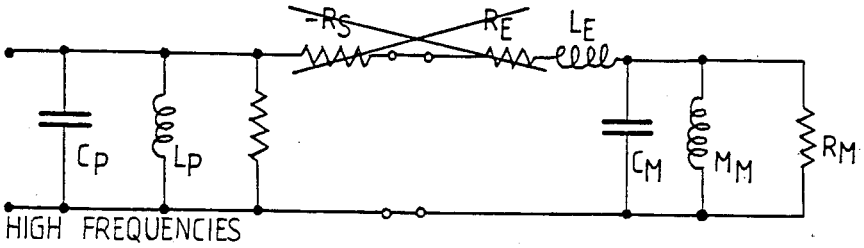
FIG. 2 shows an equivalent diagram of the same connection at high frequencies.

In order to further illustrate the problem on which the invention is based it is referred to FIGS. 1 and 2.

FIG. 1 shows an equivalent diagram of such an audio bass amplifier connection shown in the above-mentioned U.S. patent. The components CP, LP and RP represent the equivalent capacitance, inductance and resistance, respectively, from the ACE-amplifier stage and the components CM, MM and RM are the electric equivalents of the mechanical quantities of the loudspeaker, vis. compliance, mass and damping, respectively.

The resistance $-R_s$ is the negative output resistance from the amplifier stage that in theory should be as high as RE, the resistance of the voice coil. As $-R_s+R_E$ is equal to zero the parallel sections can be combined as shown in FIGS. 1 and 2 and the mass, stiffness and damping on the loudspeaker element increase.

However, at high frequencies (about 100–500 Hz) the voice coil inductance LE will influence and the two parallel sections cannot be combined. Instead a low-pass filter of the third order is obtained which is formed by the components CP, LE and CM in a so-called $\pi$-section. This filter will have a break frequency of between 100 and 500 Hz and a high Q-value as well as a damping increasing by an inclination of 18 dB/octave.

Figure 3:
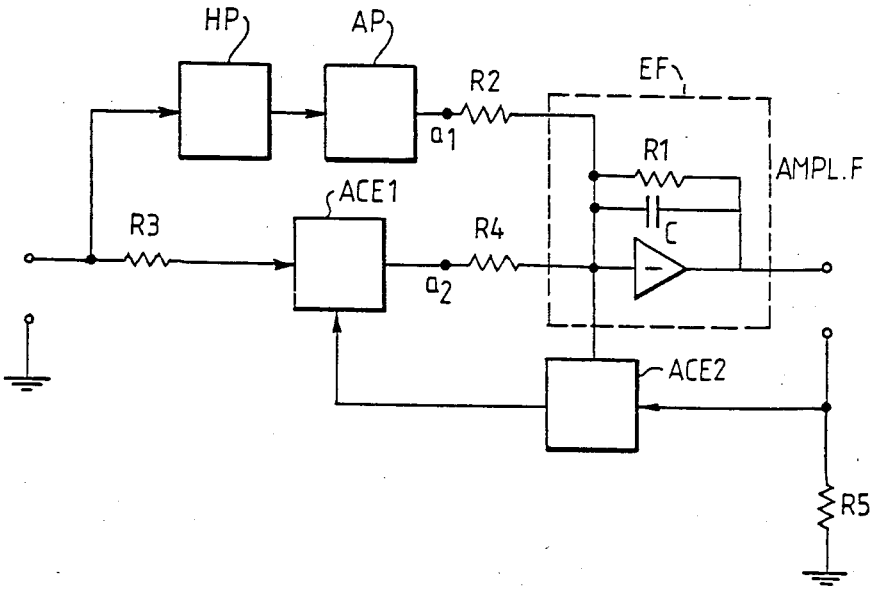
FIG. 3 shows a block diagram of a circuit arrangement according to the invention.

In FIG. 3 a block diagram of a circuit arrangement according to the invention is shown. The two blocks ACE1, ACE2 as well as the resistors R3, R4 and R5 belong to the previously known ACE-amplifier whose properties at high frequencies, i.e. frequencies higher than a certain break frequency fs, are to be improved. According to the invention a series section has been connected in parallel with ACE1 which contains a high-pass filter portion HP and a phase shifting portion AP connected up to the power amplifier EF.

The high-pass filter HP should have a break frequency fs substantially coinciding with the break frequency obtained from the low-pass filter portion according to FIG. 2 which is formed if the inductance of the voice coil is considered. Thus, the high-pass filter HP should have a break frequency taking over where the ACE-bass amplifier does not function any more.

Figure 5:
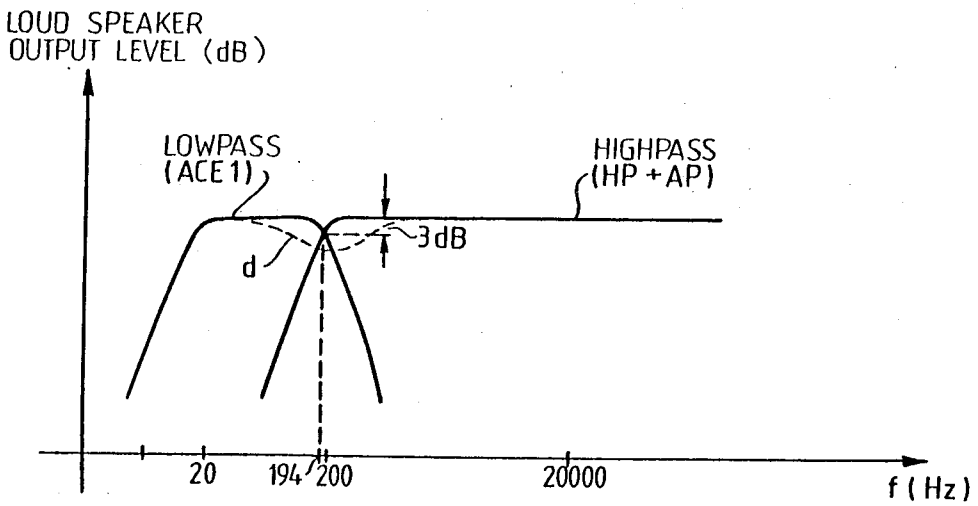
FIG. 5 shows a diagram of the level of the loudspeaker output signal as a function of the frequency of the suggested circuit arrangement.

Moreover, an all-pass filter AP or some other phase shifting circuit has been connected in series with the high-pass filter HP. It is the object of the all-pass filter AP to get the phase of the signals appearing in the points a1 and a2 substantially equal at the above-mentioned break frequency fs so that these can be combined in the combination point A in the power amplifier EF. If the signals in these points a1 and a2 are not equal a dip in the frequency response is obtained at the break frequency fs, see FIG. 5, which illustrates a diagram of the output level from the section containing the low-pass filter portion LP (ACE1) and the high-pass filter portion HP.

It can be said that the total amplifier shown in FIG. 3 operates through the suggested connection according to the known method with ACE-bass amplification until it deviates upwards in frequency due to the voice coil inductance and operates above this frequency as a current-current feedback amplifier where the resistors R2 and R1 decide the amplification according to the known relationship $F=-R1/R2$.

Figure 4:
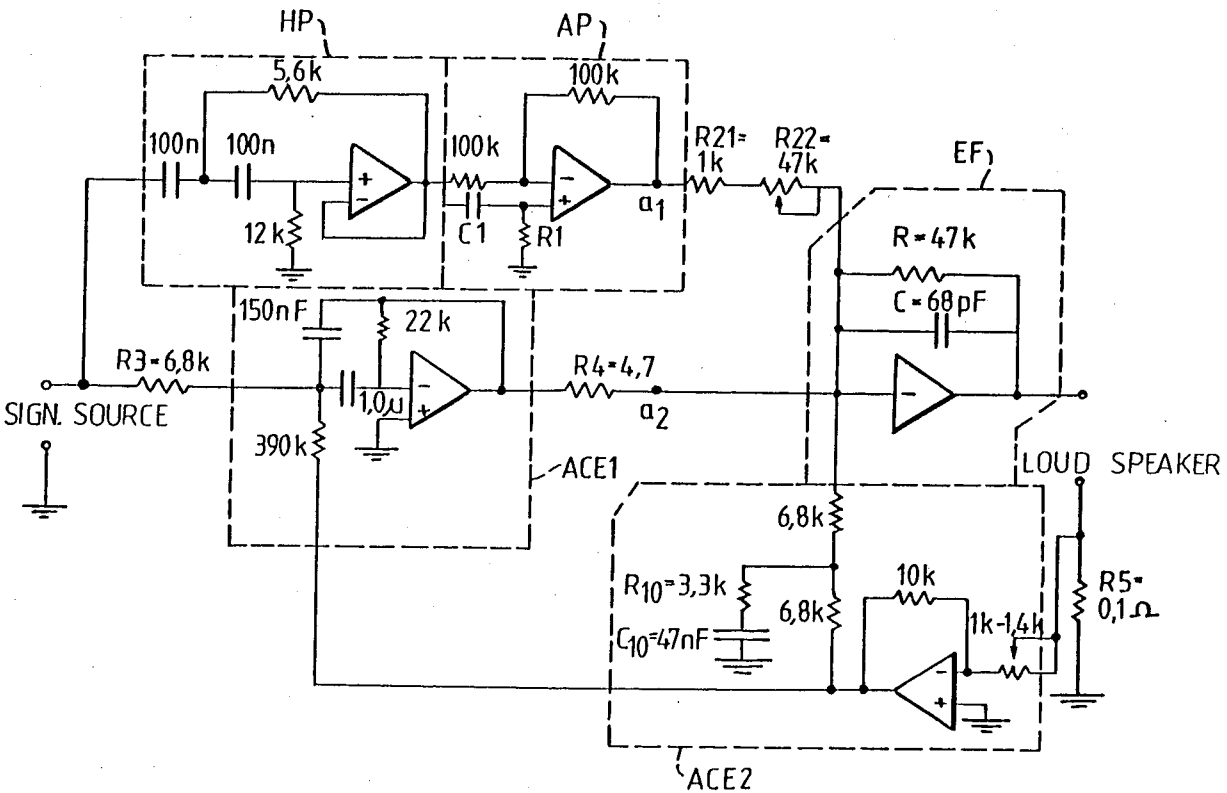
FIG. 4 shows more closely an embodiment of the circuit arrangement according to FIG. 3 in a circuit diagram.

FIG. 4 shows more closely how the high-pass filter HP and (in this case) the all-pass filter AP can be designed. Furthermore, the design of the two blocks ACE1 and ACE2 according to FIG. 3 is shown in greater detail. Here the resistor R2 is a fixed resistance R21 and a variable resistance R22 in order that the amplification F should be limited ($R2=0$ brings $F=\infty$ according to the above).

The high-pass filter HP is a filter of the second order having the break frequency $$f_s = \frac{1}{2\pi\sqrt{100 \cdot 100 \cdot 10^{-18} \cdot 5{,}6 \cdot 12 \cdot 10^6}} = \frac{1}{2\pi \cdot 8{,}2 \cdot 10^{-4}} = 194 \text{ Hz}$$

and the Q-value $$Q = \frac{1}{2}\sqrt{\frac{12 \cdot 10^3}{5{,}6 \cdot 10^3}} = 0{,}73$$

The all-pass filter AP is a phase-shifting section of a type known per se where the phase shift $\rho$ is given by $$\phi = 180° - 2\tan^{-1}(f/fs)$$

and where $$fs = \frac{1}{2\pi R_1 C_1}$$

By selecting R1 and C1 in a suitable manner the phase shift of the signal passing through the section can thus be such that the phase difference in the points a1 and a2 is close to zero at the break frequency $fs=194$ Hz. Each circuit HP and AP inverts the incoming signal, i.e. this signal is phase shifted 180°, and therefore the output signal from the all-pass section AP will be uninfluenced before the output to the power amplifier EF.

The last stage ACE2 forms together with the power amplifier EF a positive feedback and, thus, gives a negative output impedance to the following loudspeaker which is required to satisfy the known method mentioned above of eliminating the influence of the resistance of the voice coil winding. The components $C_{10}$ and $R_{10}$ in FIG. 4 will reduce the positive feedback at fs to reduce the Q-value of the low-pass filter portion ACE1. The best Q-value is $$Q = \frac{1}{\sqrt{2}}$$

for flat frequency response. In the diagram according to FIG. 5 this frequency response is shown (with a continuous line) for a cophasal state in point A. The dashed curve d shows the frequency response in the vicinity of $fs=194$ Hz if the signals are not in the phase.

The high-pass filter HP should be one of the second order which is suitable as the section is to transmit high-frequency signals, but it is a matter of course that a high-pass filter of a higher or lower order can be selected in dependence on the separate case. As mentioned above, it is not necessary, either, that the circuit AP should be an all-pass filter section but it can consist of any phase-shifting circuit adjusting the phase at the break frequency fs so that a cophasal state is obtained in point A. However, this latter condition must be fulfilled in order to obtain a straight frequency response in the total amplifier circuit.

I claim:

1. An amplifier comprising:
(a) an input port;
(b) an output port;
(c) a low-pass filter having a break-point frequency, connected to said input port, for producing low-pass signals at a phase;
(d) a power amplifying circuit connected to said low-pass filter for receiving said low-pass signals, and said output port;
(e) a current feed-back circuit, connected to said output port, said low-pass filter and said power amplifying circuit, for effecting an output port impedance which substantially consists of a negative resistance;
(f) a high-pass filter, connected to said input port, having a break-point frequency substantially equal to the break-point frequency of said low-pass filter, for producing a high-pass signal at a phase; and
(g) a phase shifting circuit, connected in series with said high-pass filter and further connected to said power amplifying circuit, for shifting the phase of said high-pass signals to substantially the same phase as the phase of said low-pass signals.

2. An amplifier as recited in claim 1 wherein said series connection of said high-pass filter and said phase shifting circuit is itself connected in parallel with said low-pass filter to said power amplifying circuit and said input port.

3. An amplifier as recited in claims 1 or 2 wherein said high-pass filter is a high-pass filter of the second order.

* * * * *